US011803144B2

(12) United States Patent
Ikeno et al.

(10) Patent No.: US 11,803,144 B2
(45) Date of Patent: Oct. 31, 2023

(54) HEATING UNIT

(71) Applicant: Brother Kogyo Kabushiki Kaisha, Nagoya (JP)

(72) Inventors: Yuichi Ikeno, Maibara (JP); Kei Ishida, Inuyama (JP); Yasuhiro Maruyama, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/652,311

(22) Filed: Feb. 24, 2022

(65) Prior Publication Data

US 2022/0276595 A1 Sep. 1, 2022

(30) Foreign Application Priority Data

Feb. 26, 2021 (JP) ..... 2021-029495

(51) Int. Cl.
*G03G 15/20* (2006.01)

(52) U.S. Cl.
CPC ..... *G03G 15/2053* (2013.01)

(58) Field of Classification Search
CPC ..... G03G 15/2017; G03G 15/2025; G03G 15/2053; G03G 2215/2003
See application file for complete search history.

(56) References Cited

U.S. PATENT DOCUMENTS

| | | | | |
|---|---|---|---|---|
| 6,516,164 | B1 * | 2/2003 | Kawazu | H05B 1/0213 337/333 |
| 2002/0088789 | A1 * | 7/2002 | Hirai | G03G 15/2064 219/216 |
| 2007/0182798 | A1 | 8/2007 | Makihira et al. | |
| 2015/0139708 | A1 | 5/2015 | Shimura et al. | |
| 2015/0227091 | A1 | 8/2015 | Ando et al. | |
| 2016/0132006 | A1 | 5/2016 | Narahara et al. | |

FOREIGN PATENT DOCUMENTS

| | | | |
|---|---|---|---|
| JP | 2007-212589 | A | 8/2007 |
| JP | 2014-123100 | A | 7/2014 |
| JP | 2015-118365 | A | 6/2015 |
| JP | 2016-029512 | A | 3/2016 |
| JP | 2016-090865 | A | 5/2016 |

* cited by examiner

*Primary Examiner* — Thomas S Giampaolo, II
(74) *Attorney, Agent, or Firm* — BURR PATENT LAW, PLLC

(57) ABSTRACT

A heating unit includes a heater including a substrate and a resistance heating element provided on the substrate, an endless belt configured to rotate around the heater, a thermostat configured to interrupt energization to the resistance heating element when the heater is abnormally increased in temperature, the thermostat having a heat sensitive surface and a heat-insulating member disposed between the thermostat and the heater. The heat-insulating member has a heat conductivity less than that of a material constituting the heat sensitive surface. The heat sensitive surface of the thermostat is in contact with the heat-insulating member.

19 Claims, 9 Drawing Sheets

HEATING UNIT

CROSS REFERENCE TO RELATED APPLICATION

The present application claims priority from Japanese Patent Application No. 2021-029495, which was filed on Feb. 26, 2021, the disclosure of which is herein incorporated by reference in its entirety.

BACKGROUND

The following disclosure relates to a heating unit used for a fixing device of an electrophotographic type image forming apparatus or the like.

In the past, there has been known a fixing device in which a rotating belt is interposed between a heater and a pressure roller. In the fixing device, a safety element is disposed so as to be in contact with a back surface of the heater. The safety element functions as an energization interrupting member which interrupts energization to the heater when the energization interrupting member detects over-increasing in temperature of the heater in a case where an uncontrolled continuous energization to the heater is caused by a failure of a controller or the like.

SUMMARY

However, in the above described fixing device, since the energization interrupting member is in contact with the back surface of the heater, heat of the heater is liable to be transferred to the energization interrupting member at an early stage in a fixing operation (which will be hereinafter referred to as "early fixing stage") in a case where the fixing operation is started from a state in which the heating unit is clod, Accordingly, in an area at which the energization interrupting member is disposed, since a temperature of each of the heater and a belt is liable not to become a sufficient high temperature, there is a possibility that faulty fixing occurs.

An aspect of the disclosure relates to a heating unit capable of suppressing heat radiation from the heater to the energization interrupting member and suppressing faulty fixing at the early fixing stage.

In one aspect of the disclosure, a heating unit includes a heater including a substrate and a resistance heating element provided on the substrate, an endless belt configured to rotate around the heater, a thermostat configured to interrupt energization to the resistance heating element when the heater is abnormally increased in temperature, the thermostat having a heat sensitive surface, and a heat-insulating member disposed between the thermostat and the heater, the heat-insulating member having a heat conductivity less than that of a material constituting the heat sensitive surface. The heat sensitive surface of the thermostat is in contact with the heat-insulating member.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

EMBODIMENTS

Figure 1:
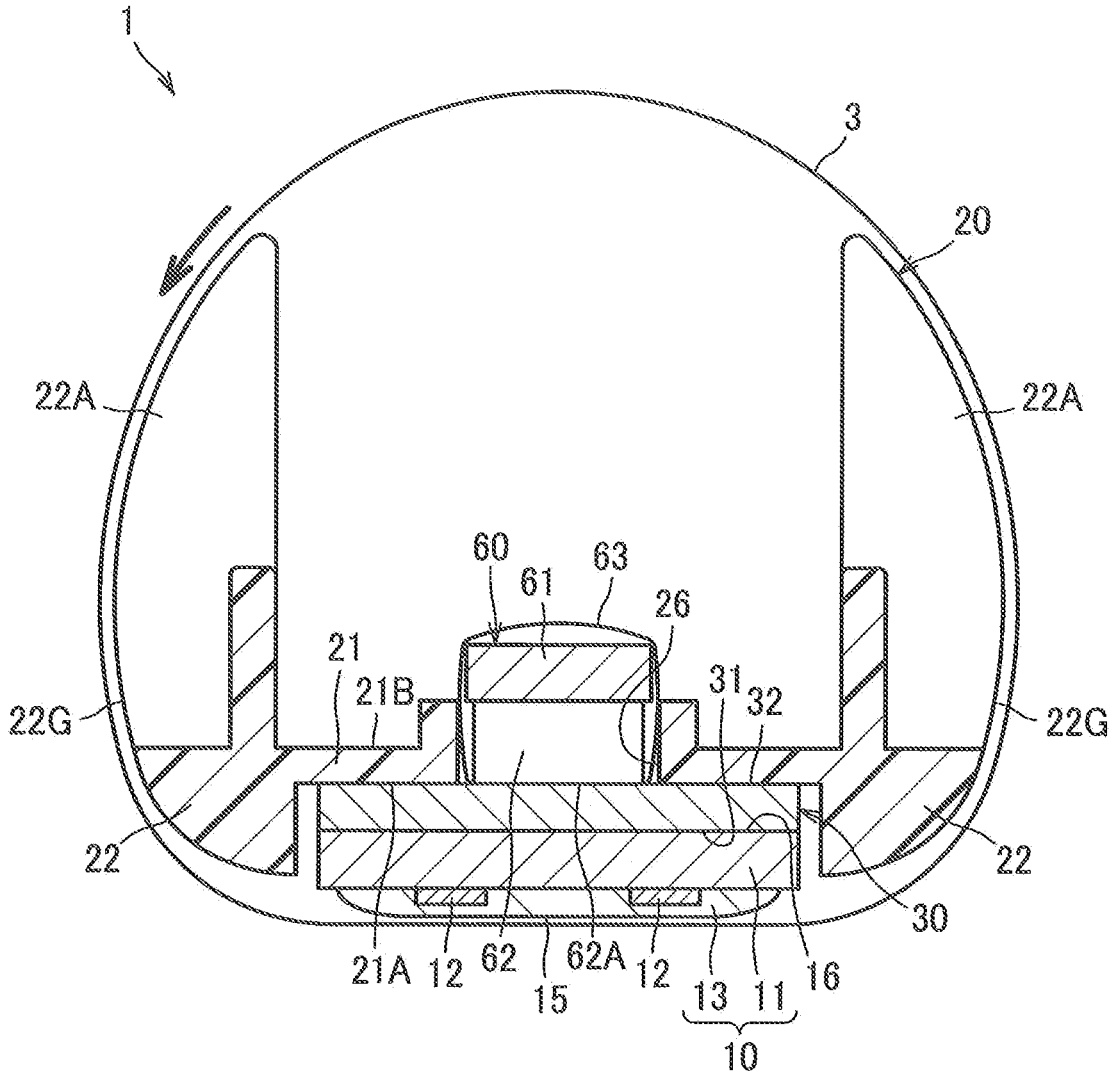
FIG. 1 is a cross-sectional view of a heating unit at a position of an energization interrupting member.

A heating unit 1 according to an embodiment is used for a fixing device of an image forming apparatus, or a device that transfers foil by heat, and the like. As illustrated in FIG. 1, the heating unit 1 includes a belt 3, a heater 10, a holder 20, a heat conductive member 30, a temperature detecting member 50 (see FIG. 4), and an energization interrupting member 60.

The belt 3 is an endless belt, which is made of metal or resin. The belt 3 rotates around the heater 10 while being guided by the holder 20. The belt 3 has an outer circumferential surface and an inner circumferential surface. The outer circumferential surface comes into contact with a sheet to be heated. The inner circumferential surface is in contact with the heater 10.

Figures 2A, 2B, 2C:
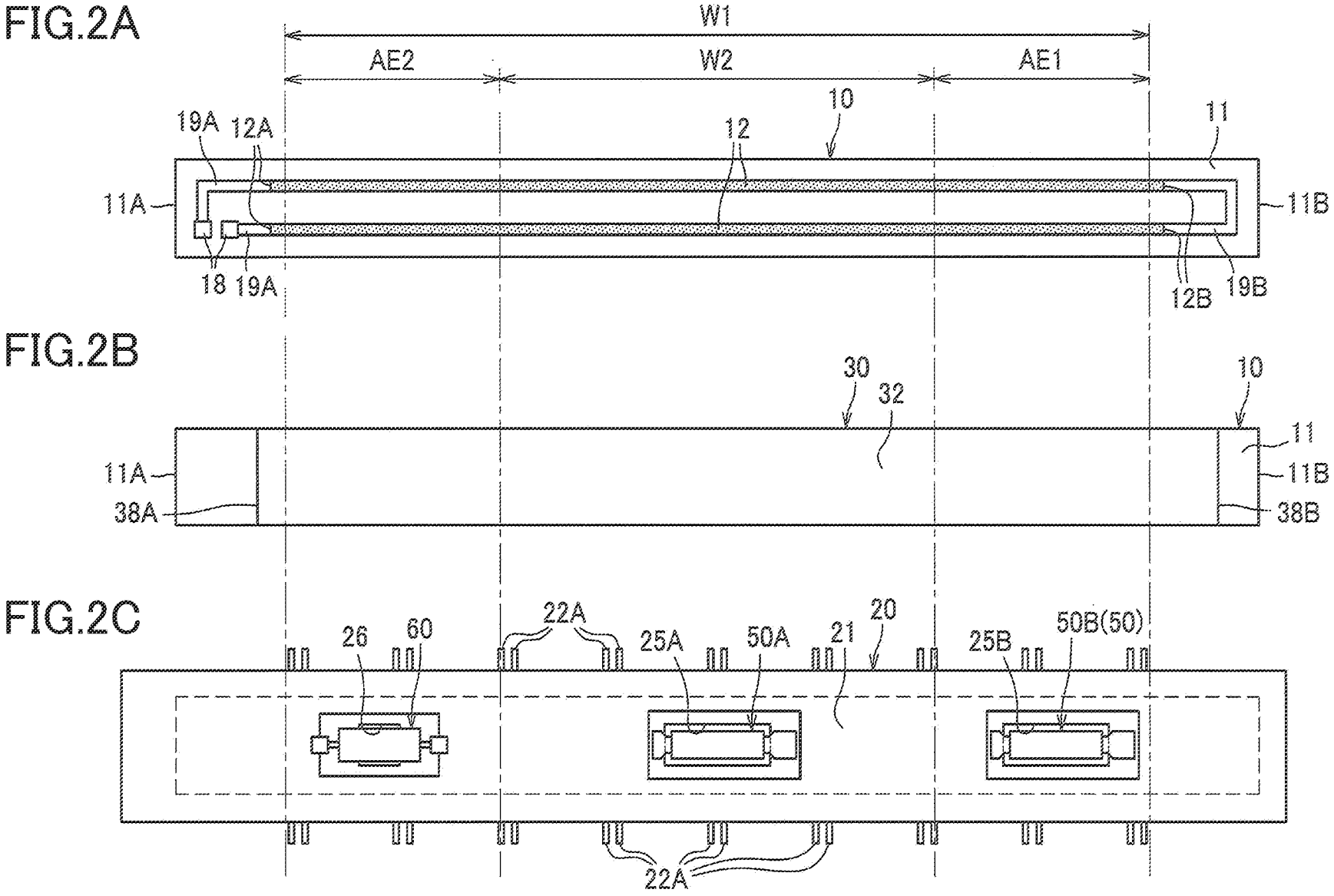
FIG. 2A is a view illustrating a surface on which resistance heating elements of a heater are disposed.
FIG. 2B is a view of the heater and a heat conductive member viewed from a back side of the heater.
FIG. 2C is a view of a holder viewed from an opposite side to the heater.

The heater 10 includes a substrate 11, resistance heating elements 12 supported by the substrate 11, and a cover 13. The substrate 11 is formed of a long rectangular plate made of ceramic. The heater 10 is a so-called ceramic heater. The resistance heating elements 12 are formed on one surface of the substrate 11 by printing. As illustrated in FIG. 2A, two resistance heating elements 12 are provided in the embodiment. The two resistance heating elements 12 are respectively disposed so as to extend in a longitudinal direction of the heater 10 (hereinafter the longitudinal direction of the heater 10 is referred to merely as a "longitudinal direction") and so as to be spaced apart from each other in parallel in a short-side direction orthogonal to the longitudinal direction. A conducting wire 19A is connected to one end 12A of each of the resistance heating elements 12, and a terminal 18 for supplying power is provided at an end portion of the conducting wire 19A of each of the resistance heating elements 12. The other ends 12B of the resistance heating elements 12 are connected to each other by a conducting wire 19B. The number of the resistance heating elements 12 is not particularly limited. The resistance heating elements may be configured such that a resistance heating element in which a heat generation amount at the center in the longitudinal direction is higher than a heat generation amount at end portions in the longitudinal direction and a resistance heating element in which the heat generation amount at end portions in the longitudinal direction is higher than the heat generation amount at the center in the longitudinal direction are provided, and such that a heat generation distribution in the longitudinal direction is regulated by individually controlling each of the resistance heating elements.

Returning to FIG. 1, the cover 13 covers the resistance heating elements 12. The cover 13 is made of, for example, glass. The heater 10 includes a nip surface 15 which is in contact with the inner circumferential surface of the belt 3 and a back surface 16 located on an opposite side to the nip surface 15.

The holder 20 is a member supporting the heater 10. The holder 20 includes a support portion 21 and guide portions 22. The support portion 21 has a plate shape corresponding to the shape of the heater 10. The support portion 21 includes a support surface 21A which is a surface facing the side on which the heater 10 is disposed and an inside surface 21B located on an opposite side to the support surface 21A. As illustrated in FIG. 2C, the support portion 21 has holder openings 25A, 25B, and 26 piercing through the support portion 21. The holder opening 25A is disposed at the center of the support portion 21 in the longitudinal direction, and has a long rectangular shape in the longitudinal direction. The holder opening 26 is disposed at one end portion of the support portion 21 in the longitudinal direction, and has an almost square shape. The holder opening 25B is disposed at the other end portion of the support portion 21 in the longitudinal direction, and has a long rectangular shape in the longitudinal direction.

The temperature detecting member 50 includes two members of a first temperature detecting member 50A and a second temperature detecting member 50B. The temperature detecting member 50 is, for example, a thermistor. The first temperature detecting member 50A and the second temperature detecting member 50B are the same components. The first temperature detecting member 50A detects a temperature at the center in the longitudinal direction of the heater 10. The first temperature detecting member 50A is used for controlling the temperature of the heater 10 such that the temperature of the heater 10 becomes a target temperature based on the temperature detected by the first temperature detecting member 50A. The second temperature detecting member 50B detects the temperature of the heater 10 at a position nearer to an end of the heater 10 in the longitudinal direction than a position at which the first temperature detecting member 50A detects the temperature. The second temperature detecting member 50B is used for detecting that the temperature is increased at the position near to the end of the heater 10. The holder opening 25A is disposed at a position corresponding to the first temperature detecting member 50A. The first temperature detecting member 50A and the second temperature detecting member 50B may not be the same component. In this case, it is preferable that the first temperature detecting member 50A is a member with higher accuracy in temperature detection than the second temperature detecting member 50B in a temperature range during printing operation.

The energization interrupting member 60 is a member configured to interrupt energization to the resistance heating elements 12 when the heater 10 is abnormally increased in temperature. The holder opening 26 is disposed at a position corresponding to the energization interrupting member 60.

Returning to FIG. 1, the guide portions 22 are provided at both ends in a short-side direction of the support portion 21. The short-side direction is a direction orthogonal to the longitudinal direction of the support portion 21. Each of the guide portions 22 includes a guide surface 22G extending along the inner circumferential surface of the belt 3. Each of the guide portions 22 has a plurality of guide ribs 22A arranged in the longitudinal direction as illustrated in FIG. 1 and FIG. 2C.

The heat conductive member 30 is a member configured to uniformize the temperature of the heater 10 in the longitudinal direction by conducting heat in the longitudinal direction of the heater 10. The heat conductive member 30 is a sheet-like member, and is located between the heater 10 and the support portion 21 of the holder 20. When the sheet as a heating target is interposed between the heating unit 1 and another pressure member, the heat conductive member 30 is interposed between the heater 10 and the support portion 21. The heat conductive member 30 includes a heater-side surface 31 which is in contact with the back surface 16 of the heater 10 and an opposite surface 32 located on an opposite side to the heater-side surface 31. The opposite surface 32 is in contact with the support surface 21A of the support portion 21.

The heat conductive member 30 is a member in which a heat conductivity in a direction parallel to the heater-side surface 31 (hereinafter referred to merely as a "planar direction") is higher than a heat conductivity of the substrate 11 in the planar direction. A material of the heat conductive member 30 is not particularly limited. For example, metals such as aluminum, aluminum alloys, and copper having high heat conductivities can be adopted, and a metal plate is an example of the heat conductive member 30. It is preferable that the heat conductive member 30 is an anisotropic heat conductive member in which the heat conductivity in the planar direction is higher than a heat conductivity in a thickness direction orthogonal to the heater-side surface 31. For example, a graphite sheet can be adopted as the anisotropic heat conductive member. A thickness of the heat conductive member 30 is not particularly limited either. For example, a film-like member thinner than 0.1 mm and a plate-like member thicker than 1 mm may be adopted. In a case where the thickness of the heat conductive member 30 is greater than 1 mm, the heat conductive member 30 may be a metal plate.

Figure 3A:
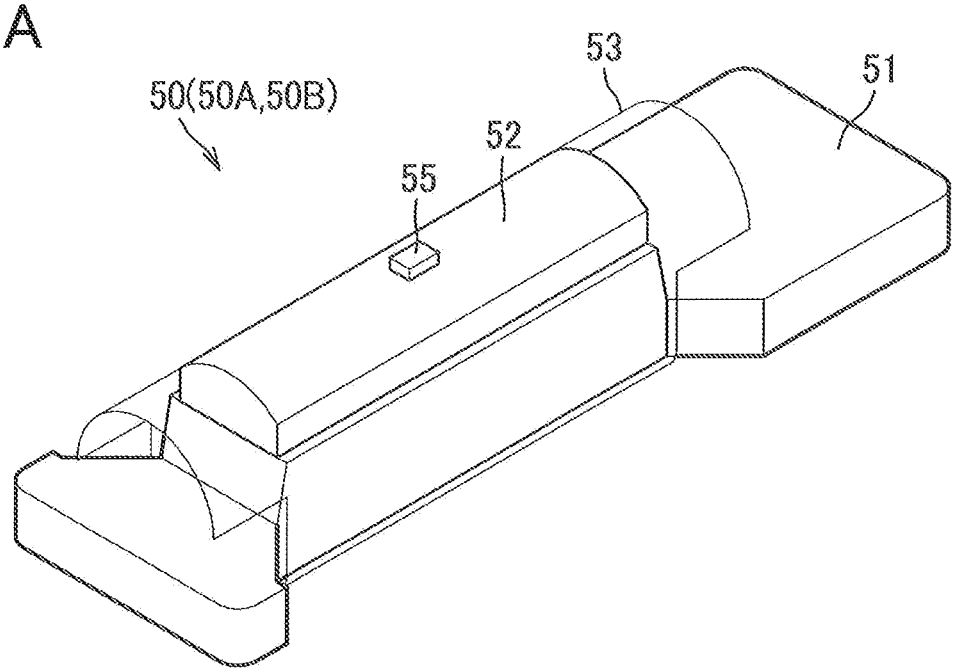
FIG. 3A is a perspective view of a temperature detecting member.

As illustrated in FIG. 3A, the temperature detecting member 50 (50A, 50B) includes a support plate 51, an urging member 52, and a temperature detecting element 55. The urging member 52 is a spongy member having elasticity, and the urging member 52 is supported by the support plate 51. The urging member 52 has a D-shape in cross section. The temperature detecting element 55 is disposed so as to be located at a most protruding portion in the urging member 52, and the temperature detecting element 55 is connected to not-illustrated wiring. A film 53 as an example of a heat-insulating member is mounted to the temperature detecting member 50. The film 53 is mounted to the support plate 51 so as to be wound around the urging portion 52 and the support plate 51. The film 53 is made of, for example, resin having high heat resistance. The film 53 includes, for example, polyimide.

Figure 3B:
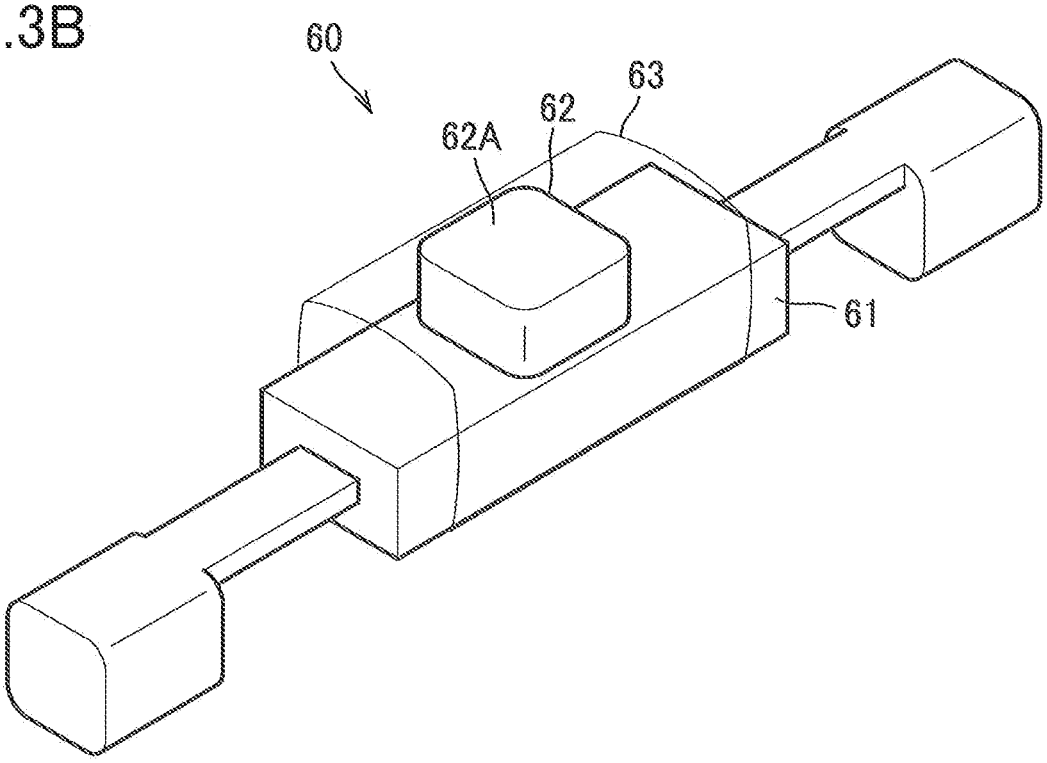
FIG. 3B is a perspective view of the energization interrupting member.

As illustrated in FIG. 3B, the energization interrupting member 60 is an example of a thermostat having an interrupting mechanism formed of bimetal and located inside the thermostat, and the energization interrupting member 60 includes a case 61 accommodating the interrupting mechanism and a detector 62 protruding from the case 61. The detector 62 has a heat sensitive surface 62A configured to detect the temperature. A film 63 as an example of a heat-insulating member is mounted to the energization interrupting member 60. The film 63 is mounted to the energization interrupting member 60 so as to be wound around the detector 62 and the case 61. The heat sensitive surface 62A is in contact with the film 63. The film 63 covers an entire of the heat sensitive surface 62A. The film 63 is made of, for example, resin having high heat resistance. The film 63 includes, for example, polyimide. The film 63 has a heat conductivity less than that of a material constituting the heat sensitive surface 62A. The material constituting the heat sensitive surface 62A is, for example, aluminum and the like.

Figure 4:
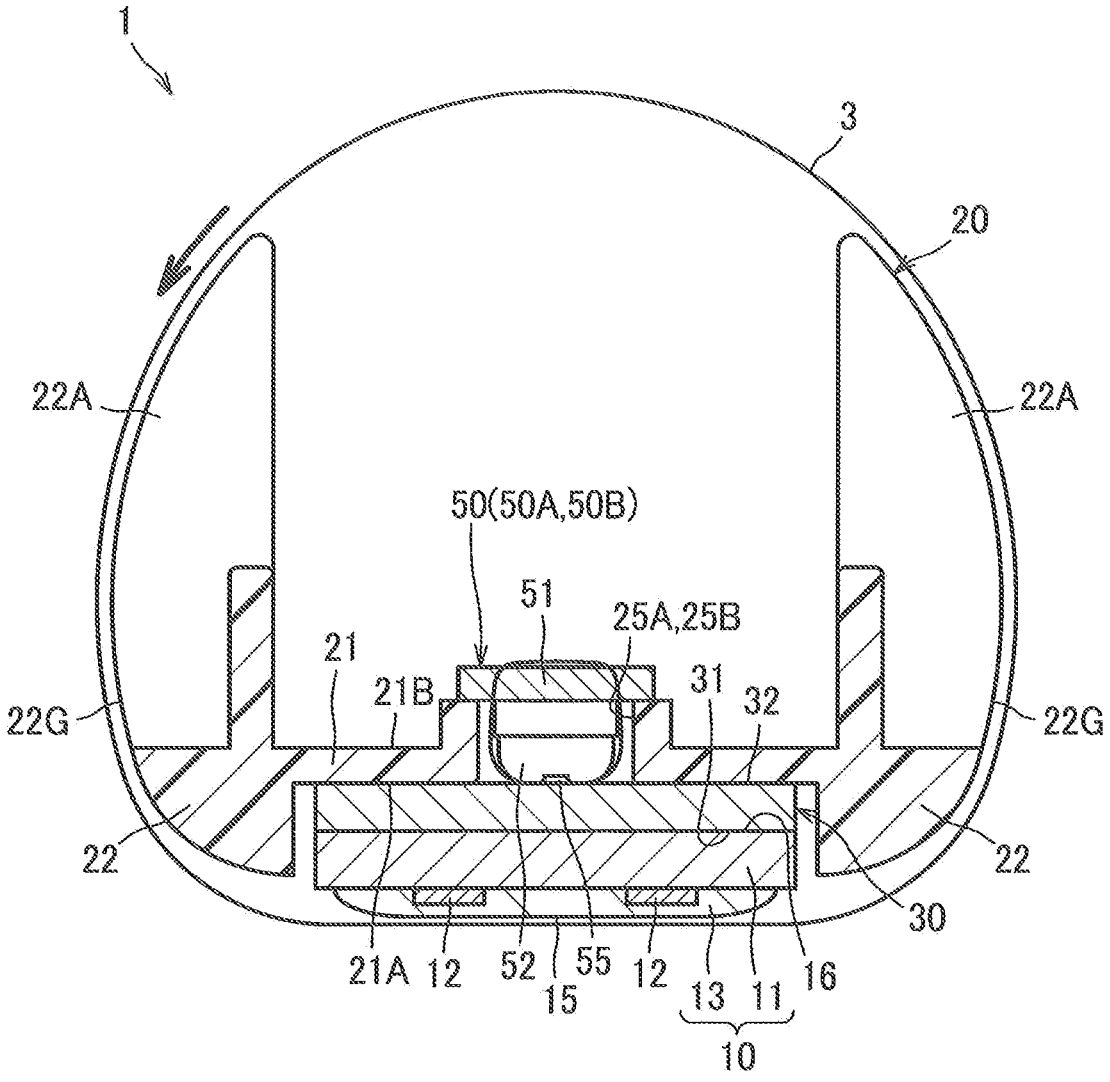
FIG. 4 is a cross-sectional view of the heating unit at a position of the temperature detecting member.

As illustrated in FIG. 4, the first temperature detecting member 50A is configured such that a portion protruding from the support plate 51 enters an inside of the holder opening 25A, and the portion protruding from the support plate 51 is in contact with the opposite surface 32 of the heat conductive member 30 through the holder opening 25A. The second temperature detecting member 50B is configured such that a portion protruding from the support plate 51 enters an inside of the holder 25B, and the portion protruding from the support plate 51 is in contact with the opposite surface 32 of the heat conductive member 30 through the holder opening 25B. The urging members 52 of the first temperature detecting member 50A and the second temperature detecting member 50B are pushed and deformed, and the temperature detecting element 55 is pushed onto the back surface 16

As illustrated in FIG. 1, the energization interrupting member 60 is configured such that the detector 62 protruding from the case 61 enters the holder opening 26, and the heat sensitive surface 62A of the detector 62 is in contact with the opposite surface 32 of the heat conductive member 30 through the holder opening 26.

As illustrated in FIG. 2C, the first temperature detecting member 50A is disposed so as to detect the temperature at positions in a range in which a sheet with a minimum width W2 usable in the heating unit 1 can pass. The second temperature detecting member 50B is disposed so as to detect the temperature at a position in a range in which the sheet with a maximum width W1 usable in the heating unit 1 can pass and out of the range in which the sheet with the minimum width W2 usable in the heating unit 1 can pass (a range located on the other-end side of the minimum width W2 in which the second temperature detecting member 50B can be disposed is illustrated in FIG. 2A as an end range AE1). The energization interrupting member 60 is disposed so as to detect the temperature at a position in the range in which the sheet with the maximum width W1 usable in the heating unit 1 can pass and out of the range in which the sheet with the minimum width W2 usable in the heating unit 1 can pass (a range located on one-end side of the minimum width W2 in which the energization interrupting member 60 can be disposed is illustrated in FIG. 2A as an end range AE2).

Then, one ends 12A and the other ends 12B of the resistance heating elements 12 are located on outer sides of the maximum width W1 and on an inner side of one end portion 38A and the other end portion 38B of the heat conductive member 30 in the longitudinal direction. That is, a length of the heat conductive member 30 is longer than a length of the resistance heating element 12 in the longitudinal direction.

The one end portion 38A and the other end portion 38B of the heat conductive member 30 are located on outer sides of the one ends 12A and the other ends 12B of the resistance heating element 12 and on an inner side of one end 11A and the other end 11B of the substrate 11 in the longitudinal direction. That is, a length of the substrate 11 is longer than the length of the heat conductive member 30 in the longitudinal direction.

There will be described operations and effects of the above described heating unit 1. In a case where fixing operation is started from a state in which the heating unit 1 is cold, energization to the resistance heating element 12 is executed in a state in which the belt 3 is rotated, and the heater 10 is heated such that a temperature of the heater 10 becomes a target temperature which is a temperature capable of fixing. Then, after the temperature of the heater 10 detected by the first temperature detecting member 50A becomes the target temperature, the fixing of toner or foil is started.

At this time, in a case where a heat capacity of the detector 62 of the energization interrupting member 60 is greater than that of the temperature detecting element 55 of the first temperature detecting member 50A, there is a case in which the temperature of the detector 62 is less than the target temperature. In the heating unit 1 according to the present embodiment, since the film 63 as a heat-insulating member is disposed between the heat sensitive surface 62A of the energization interrupting member 60 and the back surface 16 of the heater 10, it is possible to suppress heat radiation from the heater 10 to the energization interrupting member 60 at an early stage of fixing in a state in which the temperature of the energization interrupting member 60 does not become a sufficient high temperature. Accordingly, it is possible to suppress faulty fixing at the early fixing stage.

Moreover, since the heating unit 1 is configured such that the heat conductive member 30 is disposed between the film 63 and the heater 10, it is possible to uniformize the temperature of the heater 10 in the longitudinal direction of the heater 10.

Since the length of the heat conductive member 30 in the longitudinal direction is longer than the length of the resistance heating element 12, it is possible to uniformize the temperature of the heater 10 in the entire range in which the resistance heating elements 12 are disposed in the longitudinal direction.

Moreover, since the film 63 covers the entire of the heat sensitive surface 62A, it is possible to suppress the heat radiation from the heater 10 to the energization interrupting member 60 at the early fixing stage more effectively.

The embodiment of the present disclosure has been explained above. The present disclosure is not limited to the above embodiment and can be achieved by being modified suitably.

For example, in the embodiment, the film 63 which is a sheet made of resin is represented as the heat-insulating member, however, the heat-insulating member may be a member having a heat conductivity less than that of a material constituting the heat sensitive surface 62A, and the film 63 may be an indefinite shaped member such as grease. Moreover, the heat-insulating member may has a block shape. The heat-insulating member may be disposed so as to cover a part of the heat sensitive surface 62A instead of covering the entire of the heat sensitive surface 62A.

The number of the temperature detecting member and the energization interrupting member is not limited. Only one temperature detecting member may be provided, and three or more temperature detecting members may be provided. Moreover, two or more energization interrupting members may be provided.

Figures 5A, 5B, 5C:
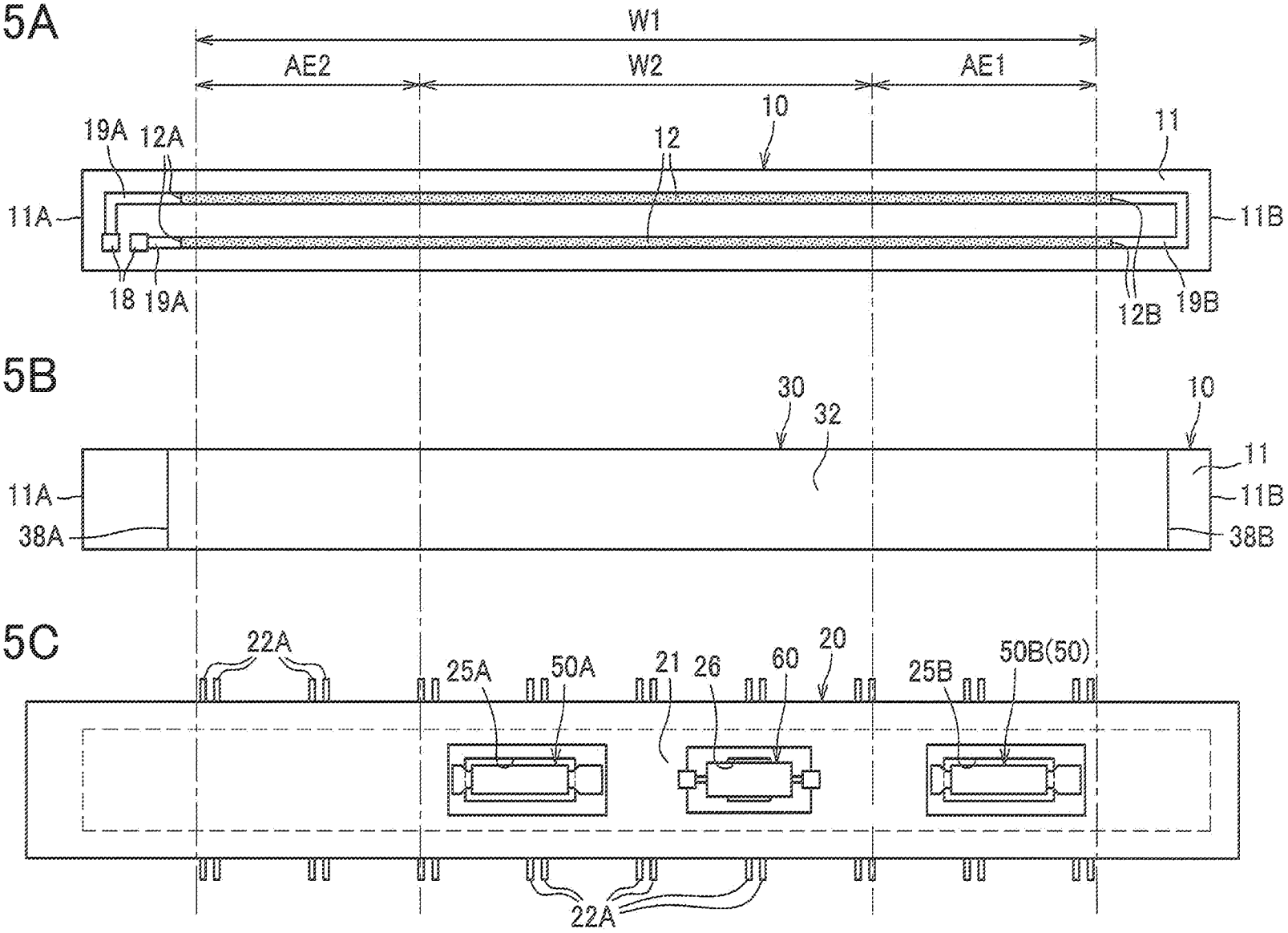
FIG. 5A is a view illustrating a surface on which resistance heating elements of the heater are disposed according to a modification.
FIG. 5B is a view of the heater and the heat conductive member viewed from the back side of the heater.
FIG. 5C is a view of a holder viewed from an opposite side to the heater.

Moreover, the energization interrupting member 60 may be disposed so as to detect the temperature at a position in the range in which the sheet with the minimum width W2 usable in the heating unit 1 can pass as in a modification illustrated in FIG. 5C. Also in this case, since the film 63 as the heat-insulating member is disposed between the heat sensitive member 62A of the energization interrupting member 60 and the back surface 16 of the heater, it is possible to suppress the heat radiation from the heater 10 to the energization interrupting member 60 at the early fixing stage in the case where the temperature of the energization interrupting member 60 does not become a sufficient high temperature. Since the energization interrupting member 60 is disposed at the position in the range in which the sheet with the minimum width W2 usable in the heating unit 1 can pass, therefore, it is possible to detect abnormal temperature increase of the heater 10 regardless of the size of the sheet in the width direction.

Figure 6:
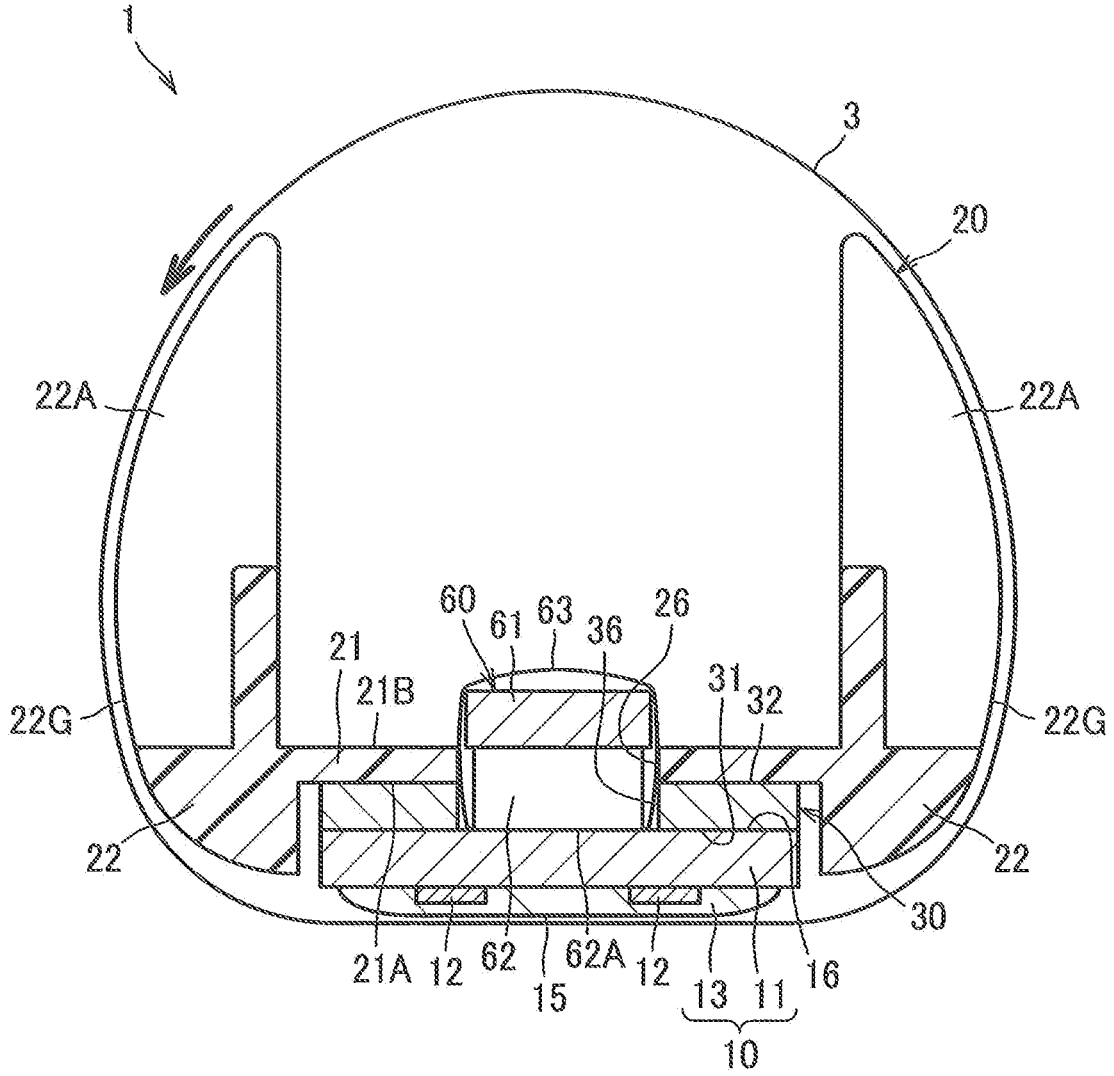
FIG. 6 is a cross-sectional view of the heater at a position of the energization interrupting member according to a modification.

Moreover, as a modification illustrated in FIG. 6, the energization interrupting member 60 may be configured such that the heat sensitive member 62 A of the detector 62 is in contact with the back surface 16 of the heater 10 through the holder opening 26. In this case, the heat conductive member 30 has an opening 36 piercing the heat conductive member 30. The opening 36 is disposed at a position corresponding to the holder opening 26, that is, a position corresponding to the energization interrupting member 60. The energization interrupting member 60 is configured such that the detector 62 protruding from the case 61 enters the holder opening 26 and the opening 36, and the detector 62 is in contact with the back surface 16 of the heater 10 through the holder opening 26 and the opening 36. Also in this case, since the film 63 as the heat-insulating member is disposed between the heat sensitive surface 62A of the energization interrupting member 60 and the back surface 16 of the heater 10, it is possible to suppress the heat radiation from the heater 10 to the energization interrupting member 60 in the case where the temperature of the energization interrupting member 60 does not become the sufficient high temperature at the early fixing stage. Moreover, since the energization interrupting member 60 is in contact with the back surface 16 of the heater 10 through the opening 36, it is possible to immediately interrupt energization to the heater 10 when the energization interrupting member 60 detects the abnormal temperature increase with high responsiveness.

Moreover, in the case where the energization interrupting member 60 is in contact with the back surface 16 of the heater 10, the heat conductive member 30 may not be provided.

Figure 7:
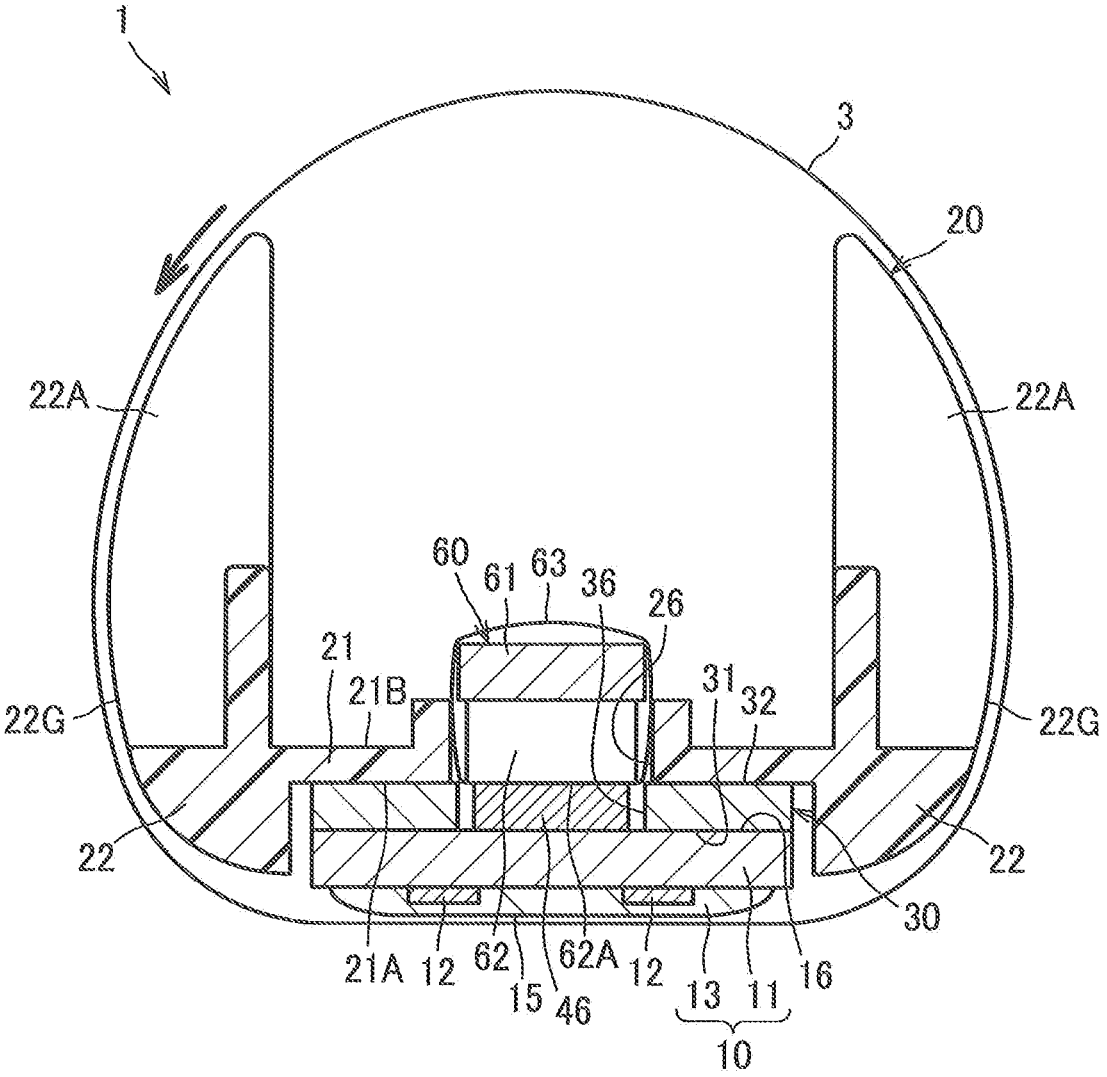
FIG. 7 is a cross-sectional view of the heater according to a modification in a case where a second heat conductive member is provided.

Moreover, as a modification illustrated in FIG. 7, the energization interrupting member 60 may be configured such that the heat sensitive member 62A of the detector 62 is in contact with a second heat conductive member 46 through the holder opening 26. In this case, the heat conductive member 30 has the opening 36 piercing the heat conductive member 30 as the same as the modification illustrated in FIG. 6. The second heat conductive member 46 is located in the opening 36. A dimension of the second heat conductive member 46 is smaller than that of the heat conductive member 30. The second heat conductive member 46 is a member having a heat conductivity in the planar direction is greater than that of the substrate 11 in the planar direction. A material constituting the second heat conductive member 46 is not limited, however, for example, metals such as aluminum, aluminum alloys, and copper having high heat conductivities can be adopted. The second heat conductive member 46 is located between the two resistance heating elements 12. It is preferable that at least a heat conductivity in a thickness direction of the second heat conductive member 46 is greater than that of the heat conductive member 30. The energization interrupting member 60 is configured such that the detector 62 protruding from the case 61 enters the holder opening 26, and is in contact with a surface of the second heat conductive member 46 located on an opposite side to the heater 10 through the holder opening 26. Also in this case, since the film 63 as the heat-insulating member is disposed between the heat sensitive member 62A of the energization interrupting member 60 and the second heat conductive member 46, it is possible to effectively suppress the heat radiation from the heater 10 to the energization interrupting member 60 in the case where the temperature of the energization interrupting member 60 does not become the sufficient high temperature at the early fixing stage. Moreover, since the energization interrupting member 60 is in contact with the second heat conductive member 46 which is different from the heat conductive member 30, it is possible to uniformize temperature unevenness due to disposition of the resistance heating elements 12 by the second heat conductive member 46. Accordingly, it is possible to detect an accurate temperature by the energization interrupting member 60.

Figure 8:
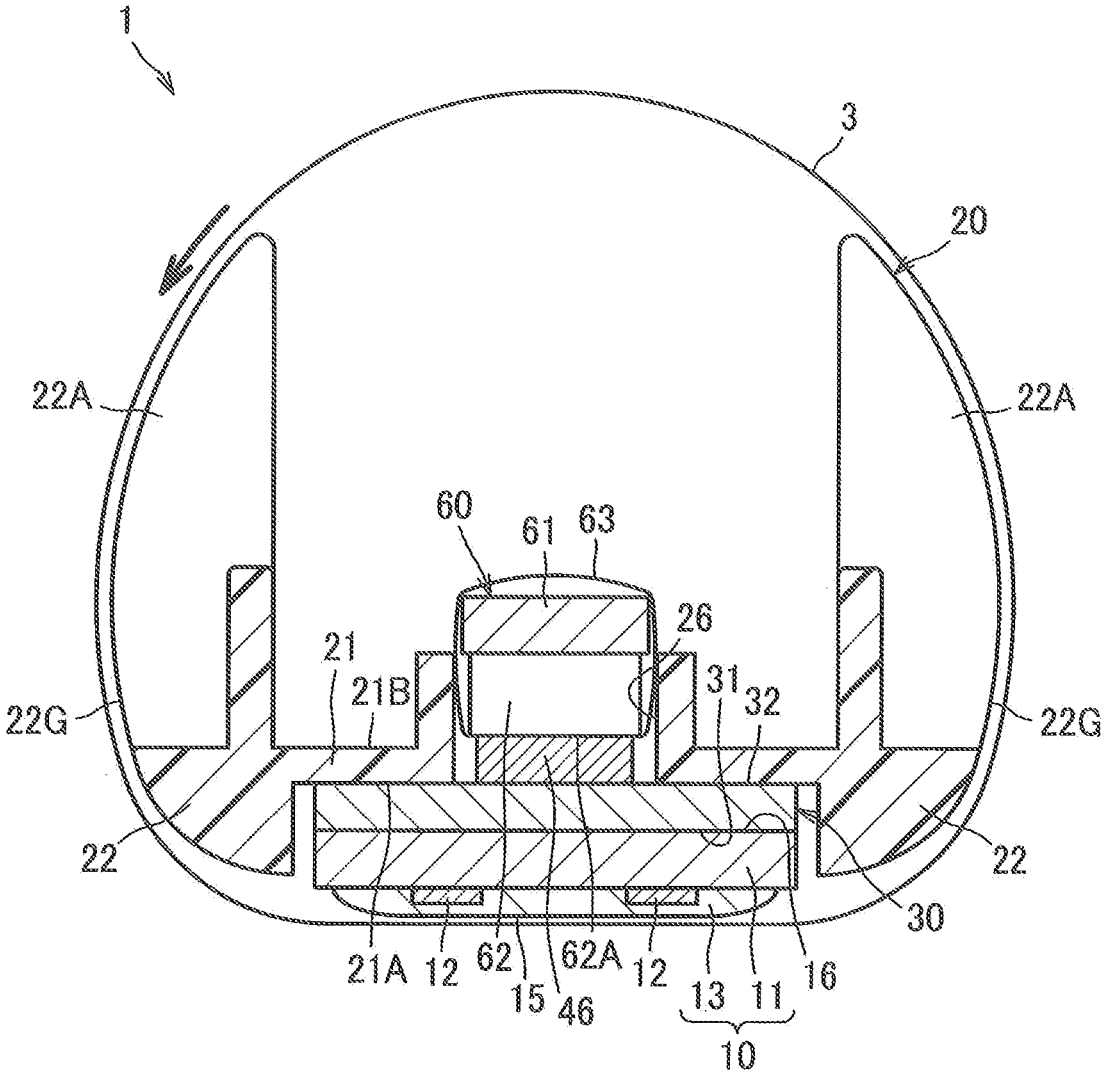
FIG. 8 is a cross-sectional view of the heater according to another modification in a case where the second heat conductive member is provided.

Moreover, as a modification illustrated in FIG. 8, the second heat conductive member 46 may be disposed at a position corresponding to the holder opening 26 and may be in contact with the heat conductive member 30. In this case, the heat conductive member 30 does not have the opening piercing the heat conductive member 30, which is different from the modification illustrated in FIG. 7. The energization interrupting member 60 is configured such that the detector 62 protruding from the case 61 enters the holder opening 26, and is in contact with the surface of the second heat conductive member 46 located on the opposite side to the heater 10 through the holder opening 26. Also in this case, the film 63 as the heat-insulating member is disposed between the heat sensitive surface 62A of the energization interrupting member 60 and the second heat conductive member 46, it is possible to suppress the heat radiation from the heater 10 to the energization interrupting member 60 in the case where the temperature of the energization interrupting member 60 does not becomes the sufficient high temperature at the early fixing stage. Moreover, since the energization interrupting member 60 is in contact with the second heat conductive member 46 which is different from the heat conductive member 30, it is possible to uniformize the temperature unevenness due to the disposition of the resistance heating elements 12 by the second heat conductive member 46. Accordingly, it is possible to detect an accurate temperature by the energization interrupting member 60.

Figure 9:
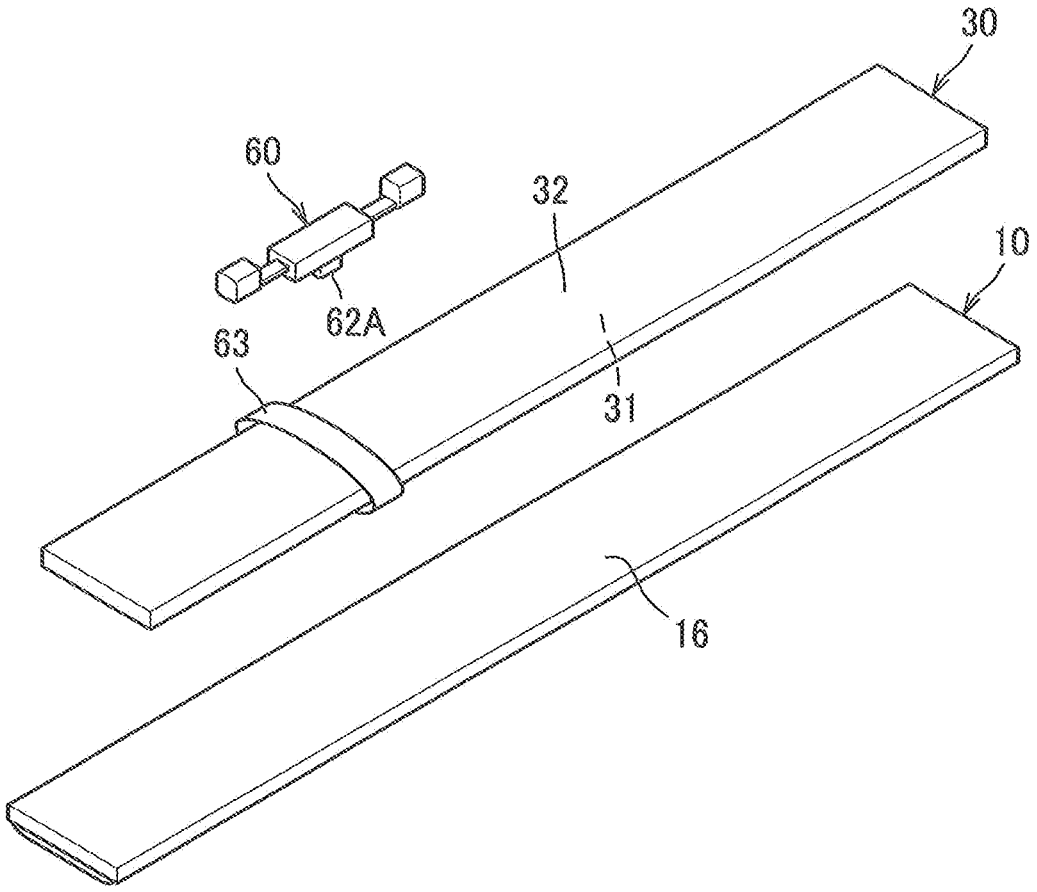
FIG. 9 is a perspective view separately illustrating the heater, the heat conductive member, a heat-insulating member and the energization interrupting member in a case where the heat-insulating member is mounted to the heat conductive member.

Moreover, as a modification illustrated in FIG. 9, the film 63 as the heat-insulating member may be mounted to the heat conductive member 30, and may be in contact with the heat sensitive surface 62A of the energization interrupting member 60. In this case, the film 63 is, for example, is wound around the heat conductive member 30 in the short-side direction at a position corresponding to the heat sensitive surface 62A in the longitudinal direction. The film 63 is located between the opposite surface 32 of the heat conductive member 30 and the heat sensitive member 62A, and is in contact with the opposite surface 32 and the heat sensitive surface 62A. Moreover, the film 63 is also disposed between the back surface 16 of the heater 10 and the heater-side surface 31 of the heat conductive member 30, and is in contact with the heater-side surface 31 and the back surface 16. As the same as the above described embodiment and modifications, the film 63 is made of, for example, resin having high heat resistance, and includes polyimide. The film 63 has a heat conductivity less than that of a material constituting the heat sensitive surface 62A. Also in this case, since the film 63 as the heat-insulating member is disposed between the heat sensitive surface 62A of the energization interrupting member 60 and the back surface 16 of the heater 10, it is possible to suppress the heat radiation from the heater 10 to the energization interrupting member 60 in the case where the temperature of the energization interrupting member 60 does not become the sufficient high temperature at the early fixing stage. Moreover, since the film 63 as the heat-insulating member is disposed also between the heat conductive member 30 and the back surface 16 of the heater 10, it is possible to further suppress the heat radiation from the heater 10 to the energization interrupting member 60.

In the above embodiment and modifications, the heat conductive member 30 is formed of one sheet-like member, however, the heat conductive member 30 may be formed of a combination of a plurality of sheet-like members. In this case, materials, heat conductivities, and shapes of the plurality of sheet-like members may be different from one another and may be the same as one another.

In the above embodiments, the substrate 11 of the heater 10 is formed of the long rectangular plate made of ceramic, however, the substrate 11 may be formed of a long rectangular plate made of metal such as stainless steel.

Respective components explained in the above embodiments and modification examples may be arbitrarily combined to achieve the disclosure.

What is claimed is:

1. A heating unit, comprising:

a heater including a substrate and a resistance heating element provided on the substrate;

an endless belt configured to rotate around the heater;

a thermostat configured to interrupt energization to the resistance heating element when the heater is abnormally increased in temperature, the thermostat having a heat sensitive surface; and a heat-insulating member disposed between the thermostat and the heater, the heat-insulating member having a heat conductivity less than that of a material constituting the heat sensitive surface, wherein the heat sensitive surface of the thermostat is in contact with the heat-insulating member, and wherein the heat-insulating member is a film.

2. The heating unit according to claim 1, further comprising a heat conductive member disposed between the heat-insulating member and the heater so as to be in contact with the heater and having a heat conductivity greater than that of the substrate.

3. The heating unit according to claim 2, wherein a length of the heat conductive member in a longitudinal direction of the hater is greater than that of the resistance heating element.

4. The heating unit according to claim 2, wherein the heat conductive member is a graphite sheet.

5. The heating unit according to claim 2, wherein the heat conductive member is a metal plate.

6. The heating unit according to claim 2, wherein the heat-insulating member is located at a position between the heater and the heat conductive member.

7. The heating unit according to claim 1, wherein the heat-insulating member includes polyimide.

8. The heating unit according to claim 1, wherein the film is mounted to the thermostat by being wound around the thermostat.

9. The heating unit according to claim 1, wherein the heat-insulating member is configured to cover an entirety of the heat sensitive surface.

10. The heating unit according to claim 1, wherein the thermostat is disposed, in the longitudinal direction of the heater, at a position in a range in which a sheet with a maximum width usable in the heating unit passes and out of a range in which a sheet with a minimum width usable in the heating unit passes.

11. The heating unit according to claim 1, wherein the thermostat is disposed, in the longitudinal direction of the heater, at a position in a range in which a sheet with a minimum width usable in the heating unit passes.

12. The heating unit according to claim 1, further comprising:

a first heat conductive member disposed between the heat-insulating member and the heater so as to be in contact with the heater, the first heat conductive member including an opening, the first heat conductive member having a heat conductivity higher than that of the substrate; and a second heat conductive member located inside the opening, the second heat conductive member having a heat conductivity higher than that of the substrate, wherein the heat-insulating member is located at a position between the heat sensitive surface and the second heat conductive member.

13. The heating unit according to claim 1, further comprising:

a first heat conductive member disposed between the heat-insulating member and the heater so as to be in contact with the heater, the first heat conductive member having a heat conductivity higher than that of the substrate; and a second heat conductive member which is in contact with the first heat conductive member, the second heat conductive member having a heat conductivity higher than that of the substrate, wherein the heat-insulating member is located at a position between the heat sensitive surface and the second heat conductive member.

14. A heating unit, comprising:

a heater including a substrate and a resistance heating element provided on the substrate;

an endless belt configured to rotate around the heater;

a thermostat configured to interrupt energization to the resistance heating element when the heater is abnormally increased in temperature, the thermostat having a heat sensitive surface; and a heat-insulating member disposed between the thermostat and the heater, the heat-insulating member having a heat conductivity less than that of a material constituting the heat sensitive surface, wherein the heat sensitive surface of the thermostat is in contact with the heat-insulating member, and wherein the heat-insulating member includes polyimide.

15. The heating unit according to claim 14, wherein the heat-insulating member is a film, and wherein the film is mounted to the thermostat by being wound around the thermostat.

16. The heating unit according to claim 14, wherein the thermostat is disposed, in the longitudinal direction of the heater, at a position in a range in which a sheet with a maximum width usable in the heating unit passes, and out of a range in which a sheet with a minimum width usable in the heating unit passes.

17. A heating unit, comprising:

a heater including a substrate and a resistance heating element provided on the substrate;

an endless belt configured to rotate around the heater;

a thermostat configured to interrupt energization to the resistance heating element when the heater is abnormally increased in temperature, the thermostat having a heat sensitive surface; and a heat-insulating member disposed between the thermostat and the heater, wherein the heat sensitive surface of the thermostat is in contact with the heat-insulating member, and wherein the heat insulating member is a film.

18. The heating unit according to claim 17, wherein the film is mounted to the thermostat by being wound around the thermostat.

19. The heating unit according to claim 17, wherein the thermostat is disposed, in the longitudinal direction of the heater, at a position in a range in which a sheet with a maximum width usable in the heating unit passes, and out of a range in which a sheet with a minimum width usable in the heating unit passes.

* * * * *